United States Patent [19]

Slocombe

[11] 4,185,862

[45] Jan. 29, 1980

[54] SELF-STABILIZING MULTIPLE SLING SYSTEM AND METHOD

[76] Inventor: Hugo T. Slocombe, 2812 Iroquois Ave., Long Beach, Calif. 90815

[21] Appl. No.: 865,848

[22] Filed: Dec. 30, 1977

[51] Int. Cl.[2] ..... B66C 1/18

[52] U.S. Cl. ..... 294/74; 294/81 R

[58] Field of Search ..... 294/67 R, 67 BA, 67 DB, 294/67 E, 67 EA, 74-76, 78 R, 81 R, 87 R; 214/8, 10.5 R

[56] References Cited

U.S. PATENT DOCUMENTS

| | | | |
|---|---|---|---|
| 643,558 | 2/1900 | Tallet | 294/75 |
| 819,576 | 5/1906 | McCabe | 294/81 R X |
| 1,632,952 | 6/1927 | Daughs | 294/74 |
| 1,808,873 | 6/1931 | Weeks | 294/74 X |
| 2,603,523 | 7/1952 | Cameron | 294/74 |
| 2,622,540 | 12/1952 | Stewart et al. | 294/74 X |
| 3,343,862 | 9/1967 | Holmes | 294/81 R X |
| 3,413,027 | 11/1968 | Bohlin et al. | 294/74 X |
| 3,456,976 | 7/1969 | Husmann | 294/74 |
| 3,614,150 | 10/1971 | Pasic | 294/78 R |

*Primary Examiner*—Johnny D. Cherry

*Attorney, Agent, or Firm*—Fulwider, Patton, Rieber, Lee & Utecht

[57] ABSTRACT

A self-stabilizing multiple sling system for hoisting a load of the type characterized by a plurality of substantially identical, double-ended cargo items. The cargo items are preferably arranged on top of one another in a plurality of stacks, with the ends of the cargo items in adjacent stacks in end-to-end abutment. One embodiment includes a spreader, a hoisting bridle attached to the spreader and adapted for attachment to a cargo fall, and a pair of slings attached to the spreader. The slings are looped about a pair of the stacks of cargo items, and are spaced apart a predetermined distance such that the lifting forces on the stacks tend to tip the stacks and urge together the abutting ends of at least some of the cargo items to stabilize the draft. Other embodiments utilize a greater number of spreaders or slings or both.

10 Claims, 16 Drawing Figures

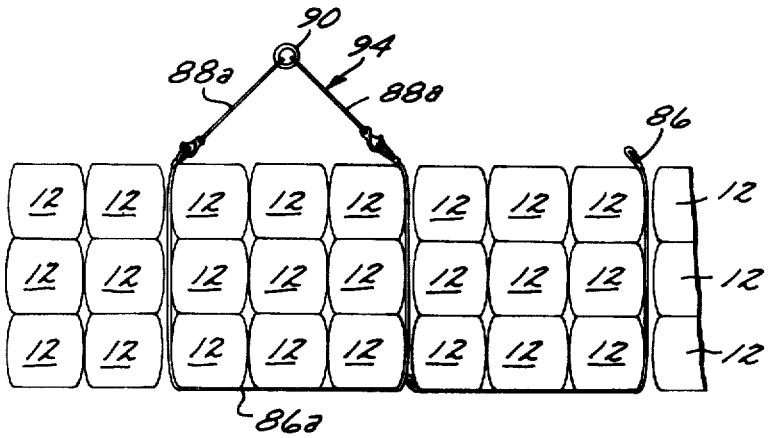
FIG. 13
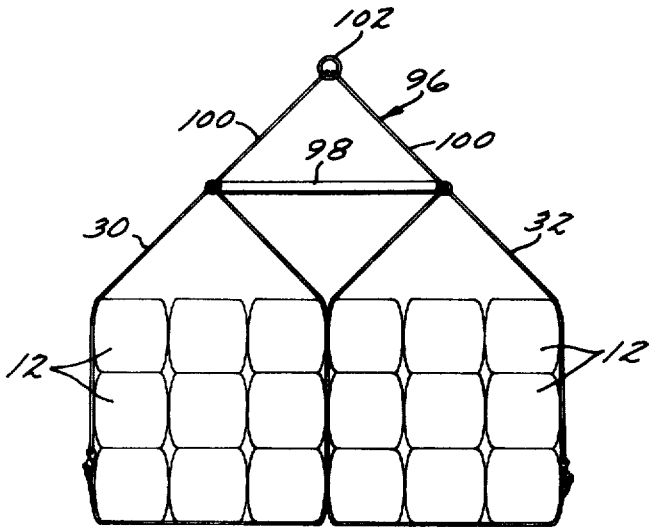
FIG. 14
FIG. 15
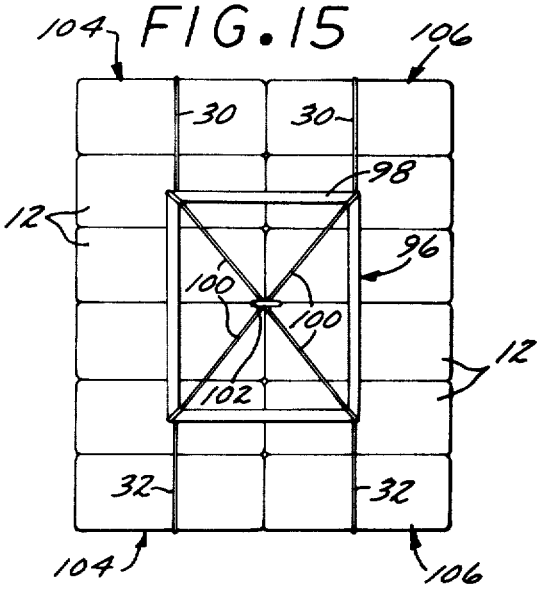
FIG. 16
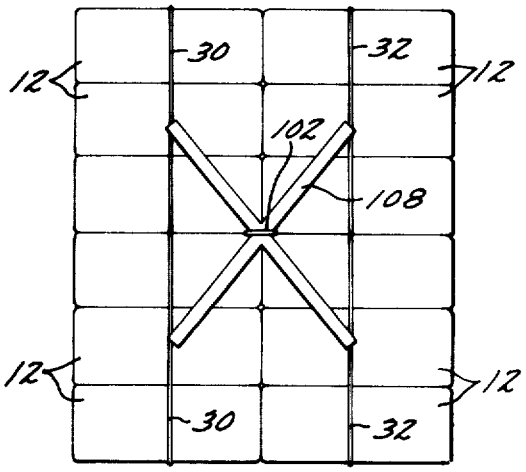

SELF-STABILIZING MULTIPLE SLING SYSTEM AND METHOD

BACKGROUND OF THE INVENTION

1. Field of the Invention

The present invention relates to cargo handling systems and methods and more particularly to a self-stabilizing multiple sling system and method adapted for handling a plurality of stacks of discrete cargo items.

2. Description of the Prior Art

The present sling system and method is adapted for handling discrete, substantially identical cargo items arranged in adjacent stacks. It is particularly adapted to handle bales of cotton.

Heretofore the loading of cotton bales aboard a ship has been a slow and tedious operation. The bales each typically weigh 500 pounds or more. The most common device used for making up and handling drafts of cotton bales to be loaded or discharged was the rope choker sling. Such a sling is simply a length of rope or wire whose ends are formed into loops. The sling is disposed about a cotton bale, with the longer portion or rove being passed through the loop of the shorter portion or bite. The ship's cargo hook is hooked onto the rove and when the draft is lifted the sling is made taut and grips tightly onto the bale. Usually one bale at a time is handled by a choker sling, although as many as four bales have been handled in this way, depending upon the size of the bales and the working conditions.

The foregoing choker sling has proved to be unsatisfactory because of the limited number of bales that can be handled at one time. Too many bales in a choker sling draft cause instability, and there is a great danger that the draft will tip and spill one or more bales out of the draft. Moreover, depending upon the weight of the draft and the type of sling material used, the sling can cut into and damage the bales and also make it difficult to disengage the sling from the bales.

Because of the instability resulting from stacking too many bales into one draft, another handling system was advanced in an attempt to speed up the loading and discharge operations. This system utilized a large platform hoisted by wire rope bridles held apart by spreaders. The stacked bales were free standing and the number of bales handled in one hoist was thus limited by safety considerations and the size of the platform used.

Another prior art method for handling cotton bales is the well-known whip or single-fall and skid system. This employs one winch and one boom with an associated fall, together with an inclined skid leading from the pier to the deck of the ship. The cargo hook on the end of the fall is hooked onto the draft and the winch is operated to drag the draft up the inclined skid, over the bullwarks, and then over to the hatch. Other systems, such as the double-whip or split-fall system or the burton system have also been used for handling single bales of cotton.

Typically, the foregoing systems have not been able to handle more than perhaps 55 to 60 bales per hour because of the considerable apprehension about stacking more than three or four bales of cotton at a time in a sling. The bales are relatively heavy and any appreciable relative movement between individual bales can result in the load spilling.

SUMMARY OF THE INVENTION

According to the present invention, there is provided a self-stabilizing multiple sling system and method for hoisting a load which is characterized by substantially identical, double-ended cargo items arranged on top of one another with their corresponding ends in general vertical alignment to form two or more stacks, the cargo items of the stacks being oriented in end-to-end abutment.

Surprisingly, one of the principal reasons for the success of the present sling system is its utilization of the tendency of stacked drafts to tip. In contrast, such tipping was a major problem in prior art systems. The present system comprises at least one spreader, a hoisting bridle attached to the spreader and adapted for attachment to a cargo fall, and at least a pair of slings attached to the spreader for looping about a pair of the stacks, respectively.

The slings are spaced apart on the spreader a predetermined distance such that each sling is located between the ends of the associated stack whereby lifting forces tend to tip the stacks one way or the other and thereby urge together the ends of at least some of the cargo items in the first stack against the abutting ends of the cargo items of the second stack to stabilize the draft.

Various spreader, hoisting bridle, and sling arrangements are encompassed within the present invention, but each depends upon the unusual and unexpected interaction of the cargo items against one another to stabilize the draft. That is, the cargo items in a stack are constrained from tipping sideways by the encircling slings, and any tipping must therefore occur toward one or the other of their ends.

By utilizing at least a pair of slings that are maintained in spaced relation by a spreader, and by stacking the cargo items in a number of layers, with the ends of the cargo items vertically aligned and in abutment with the ends of the cargo items in an adjacent stack, the tendency of the cargo items to tip or tumble in either endwise direction is prevented by the interengagement between the abutting cargo items. This unusual and unexpected result becomes more pronounced as more cargo items are stacked on top of one another. Within limits, the greater the number of layers, the more the constraint developed against endwise pivotal or tumbling movement of the bales, which is precisely the opposite effect of that experienced in prior art sling systems.

Use of the present sling system and method has greatly increased the speed and capacity for handling cotton bales. As many as 360 bales of cotton can be handled per hour with the present system and method.

Other objects and features of the invention will become apparent from consideration of the following description taken in connection with the accompanying drawings.

BRIEF DESCRIPTION OF THE DRAWINGS

FIG. 13 illustrates another form of sling utilized in conjunction with the sling of FIG. 12;

FIG. 14 is a box spreader sling according to the present invention;

FIG. 15 is a top plan view of the sling of FIG. 14; and

FIG. 16 is a top plan view of a second form of box spreader in position upon stacks of bales.

DESCRIPTION OF THE PREFERRED EMBODIMENTS

Figure 1:
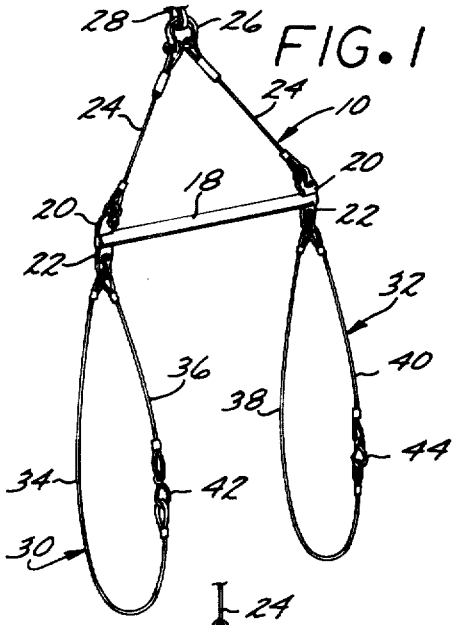
FIG. 1 is a perspective view of a multiple sling according to the present invention.
Figure 2:
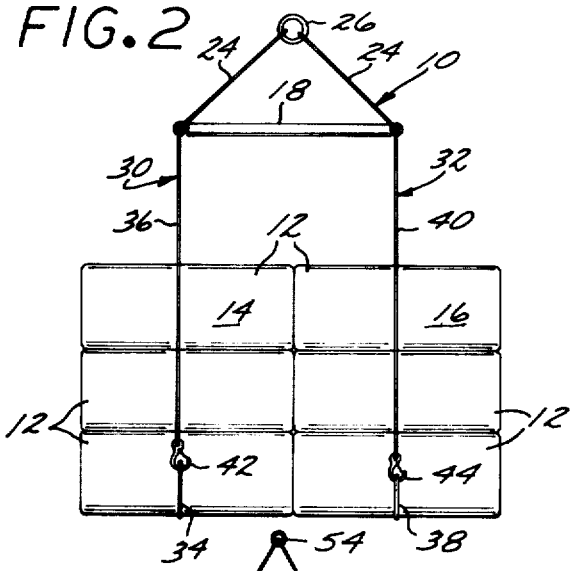
FIG. 2 is a front elevational view illustrating the sling of FIG. 1 disposed about adjacent stacks of cotton bales.
Figure 3:
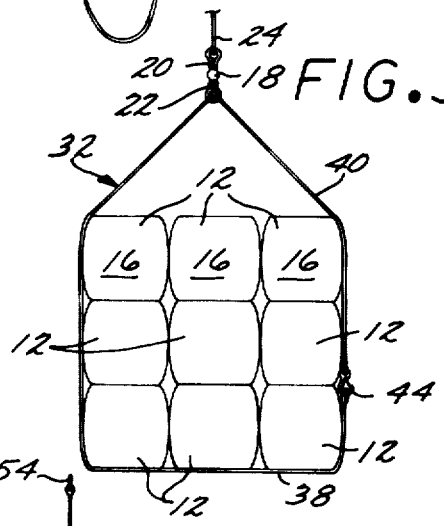
FIG. 3 is an end elevational view of the sling and bales of FIG. 2.

Referring now to the drawings, and particularly to FIGS. 1 through 3, there is illustrated a multiple sling system 10 for hoisting a load which includes a first plurality of substantially identical, double-ended cargo items such as cotton bales 12. Although the sling system 10 can handle a variety of cargo items, as will be apparent, it is particularly adapted for handling cotton bales 12. As will be seen, proper placement of the slings 10 upon the bales 12 is important. Consequently, the dimensions of the sling components are determined in part by the size of the bale. Typically, the bales are either Murray Gin bales or the somewhat smaller H.D. (High Density) bales.

For cargo handling purposes the bales 12 are arranged on top of one another with their corresponding ends in general vertical alignment to form first and second stacks 14 and 16, respectively. The bale ends in the stacks 14 and 16 are arranged in abutment so that the flat end faces of one stack bear against the corresponding end faces of the other stack.

The width of the draft in the present embodiment is two bales. As will be seen, this can be increased with different arrangements of spreaders and slings. Also, the number of tiers or layers of bales 12 may vary, but three has proved to be satisfactory and this arrangement is illustrated by way of example. Further, the depth of the load or draft may vary as desired, the load or draft illustrated by way of example being three stacks deep. Thus, the load or draft shown in FIGS. 2 and 3 amounts to eighteen bales. For convenience the numerals 14 and 16 are utilized to designate the pair of adjacent stacks in the front, and also in the middle and back vertical layers, as illustrated.

The sling system 10 includes an elongated rigid bar or spreader 18 having a pair of upper padeyes 20 and a pair of lower padeyes 22 at its opposite ends.

The upper padeyes 20 carry usual shackles which receive the lower end eyes of a pair of wire rope bridle sections or leads 24 of approximately equal length. The opposite or upper end eyes of the leads 24 are both attached to a shackle 26 which is adapted to be hooked onto a usual cargo hook 28 attached to a cargo fall (not shown) which forms part of ship cargo handling gear.

The particular padeye, shackle, and bridle arrangement are merely exemplary. Other attachment arrangements will immediately suggest themselves to those skilled in the art. The material of the slings, as will be seen, is preferably wire rope, but almost any kind of flexible material can be utilized, including chain, plastic straps, or fiber rope. Further, the leads 24 can be non-flexible rods or the like.

The sling system 10 includes a pair of wire rope slings 30 and 32 which are each made in two sections or leads 34 and 36, and 38 and 40, respectively. The longer leads 34 and 38 are each provided with end eyes, one of which is attached to a shackle fitted to one of the lower padeyes 22 of the spreader 18. The other end eyes are detachably received in hooks 42 and 44, respectively, which are attached to the associated end eye of the shorter sling lead 36 or 40. The opposite ends of the leads 36 and 40 also include end eyes, and these are received in the same padeye shackle to which the longer sling lead end eyes are fitted, as best seen in FIG. 1.

With this arrangement, the longer sling leads 34 and 38 are adapted to encircle the backs and bottoms of the bales of the stacks 14 and 16, respectively, while the shorter sling leads 36 and 40 are adapted to overlie the upper front portions of such bales.

In operation, the long sling leads 34 and 38 of the slings 30 and 32 are looped about the first and second stacks 14 and 16, respectively, and their end eyes are hooked onto the hooks 42 and 44 of the short sling leads 36 and 40 to secure the slings 30 and 32 in the positions illustrated in FIGS. 2 and 3. As will be seen, taking a strain on the shackle 26 will then be effective to lift all eighteen bales of the two stacks.

It is particularly noted that the slings 30 and 32 are spaced apart a predetermined distance on the spreader 18, relative to the size of the bales 12, such that the slings 30 and 32 are looped about the bales 12 at approximately their mid-portions. With this arrangement when the draft is hoisted the bales 12 of the first and second stacks tend to be balanced and therefore stable, tend to be urged toward each other at the top of the stacks, or tend to be urged toward each other at the bottom of the stacks, depending upon the direction of tipping. If tipping is such that the upper portions of the stacks are urged together, the upper bales 12 of the stacks cannot tumble out of the sling 30 since they are stabilized by the forcible pressing together of the upper bales. Likewise, if tipping is such that the upper bales are urged away from each other, the upper bales cannot tumble out of the sling 30 since the tipping required for this to occur is prevented by the forcible pressing together of the bottom bales of the two stacks. This unusual and surprising stability occurs because of and not in spite of stacking the bales 12 in a number of adjacent stacks in one sling load.

Figure 4:
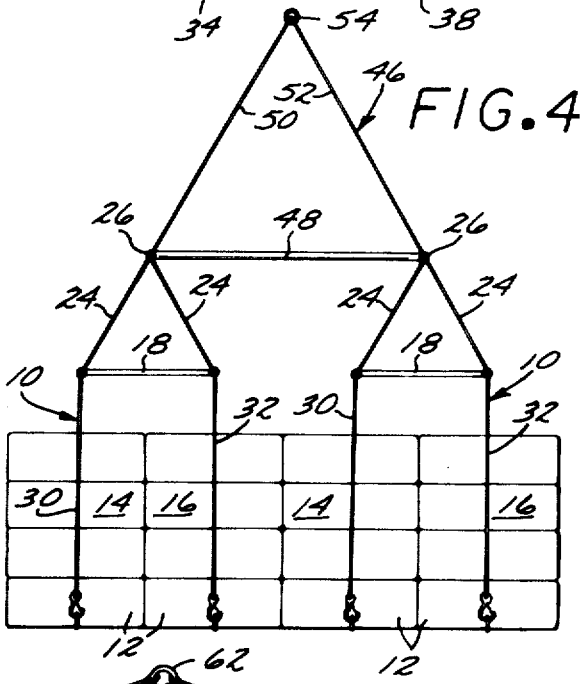
FIG. 4 is a front elevational view of another embodiment of the present sling system, in which multiple spreaders are utilized in conjunction with additional slings.
Figure 5:
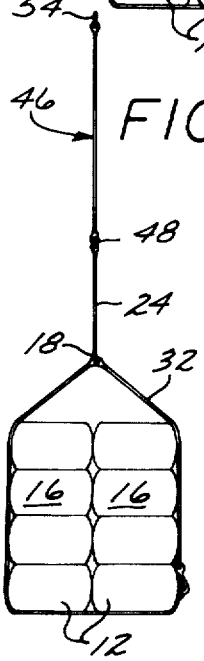
FIG. 5 is an end elevational view of the sling and bales of FIG. 4.

FIGS. 4 and 5 illustrate a triple spreader sling system 46 which is a combination of two of the sling systems 10 mounted to a third elongated bar or spreader 48. Like numerals are employed to designate components which are essentially identical to the components of the sling system 10.

The system 46 is adapted to hoist 32 bales 12 at one time, the bales 12 being arranged in two sets of adjacent stacks 14 and 16 four layers high and two layers deep. Each of the two sets of stacks 14 and 16 are carried within separate sets of slings 30 and 32, respectively.

Each stack 14 and 16 is arranged in the same relationship as for the slings 30 and 32 of the first embodiment. In addition, the bales of the stack 16 of the first set are oriented with their outer end faces in abutment with the outer end faces of the bales of the stack 14 of the second set, as best seen in FIG. 4.

The pair of shackles 26 of adjacent sling systems 10 for the two sets of stacks 14 and 16 are carried at opposite ends of the spreader 48. In addition, a bridle arrangement comprising a pair of leads 50 and 52 of equal length are attached at their lower ends to the ends of the spreader 48 and at their upper ends to a shackle 54 which is adapted to be hooked onto the usual ship's cargo hook 28 (not shown).

Hoisting on the shackle 54 causes the two pairs of slings 30 and 32 to grip their respective bales 12. The gripping and hoisting action of each pair of slings 30 and 32 upon their associated stacks 14 and 16 is the same as that described in connection with the embodiment of FIGS. 1 through 3. Thus, the stacks 14 and 16 each stabilize one another against tipping. In addition, there is a stabilizing effect caused by the abutment of one set of stacks 14 and 16 against the other set of stacks 14 and 16. Thus, all of the bales 12 of the draft are stabilized. Any tendency of any of the bales 12 to tumble out of the draft by tipping either inwardly or outwardly in an endwise direction is resisted by virtue of the forcible engagement between the upper or lower bales of the various stacks 14 and 16.

Figure 6:
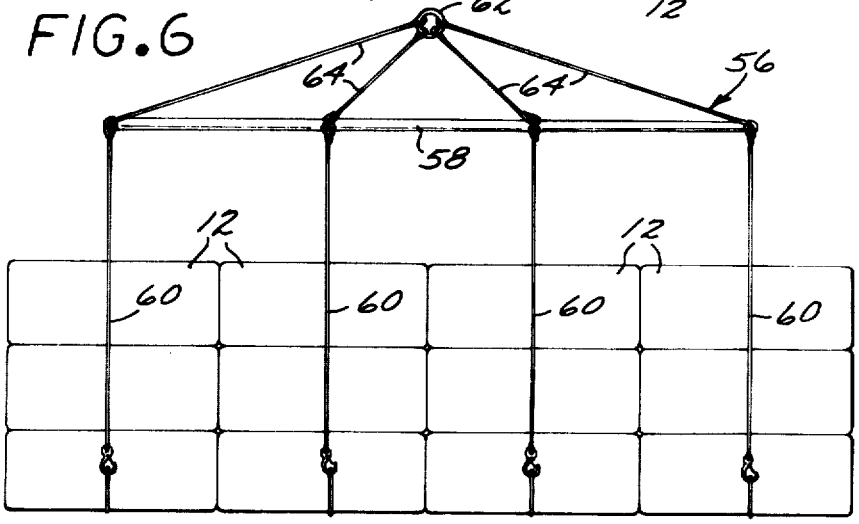
FIG. 6 is a front elevational view of another form of sling utilizing a single spreader in association with four slings.

Referring now to FIG. 6, a low profile outreach spreader system 56 is illustrated. The system 56 comprises a single spreader 58 to which four slings 60 are attached at equally spaced intervals. The spreader 58 is identical to the spreader 18 of FIG. 1, except that it is longer and includes padeyes (not shown) for effecting attachment of the slings 60. In addition, each sling 60 is substantially identical to either sling 30 or 32 of the embodiment of FIG. 1. Accordingly, further description of the spreader 58 and slings 60 will be omitted for brevity.

The slings 60 are looped about bales 12 stacked three layers high in four stacks which are three deep (not shown). The spreader 58 is attached to a hoisting ring 62 by elongated leads 64 attached at their upper ends to the ring 62 and at their lower ends to the spreader 58 adjacent the upper ends of the slings 60.

The ring 62 is adapted to be hooked onto the usual ship's cargo hook for hoisting the draft. In a manner similar to that previously described in connection with the embodiments of FIGS. 1 through 3 and FIGS. 4 and 5, hoisting action upon the slings 60 tends to urge the bales 12 against one another in a stabilizing action. That is, any undue tipping of the bales 12 relative to one another is resisted by the abutting adjacent bales.

Figure 7:
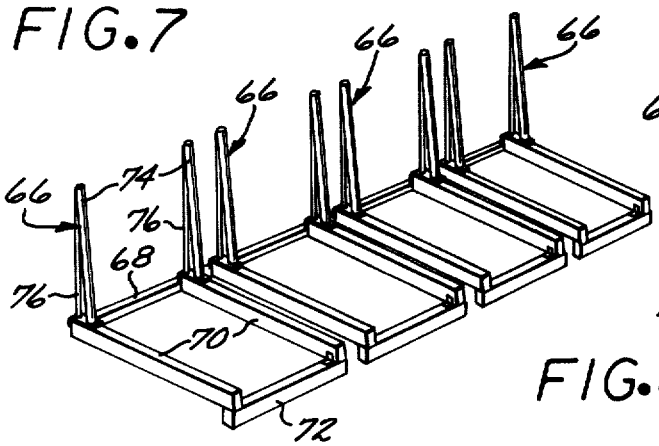
FIG. 7 is a perspective view of four receiving racks for receiving and making up the bales of cotton into stacks for handling by the present sling system.
Figure 8:
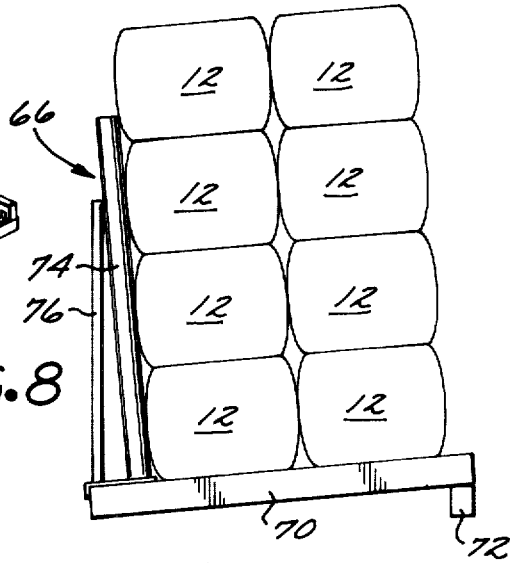
FIG. 8 is an enlarged end elevational view of the racks of FIG. 7, illustrating stacks of bales thereon.

Referring now to FIGS. 7 and 8, four receiving racks 66 are illustrated which are adapted to receive eight of the bales 12. The racks 66 facilitate disposition of the slings of one of the sling systems of the present invention about the bales 12.

Each receiving rack 66 comprises a rectangular base having a rear frame member 68 nailed to the ends of a pair of side frame members 70. A front frame member 72 is nailed to the underside of the front ends of the side frame members 70 so that the upper surfaces of the members 70 slope downwardly and rearwardly.

A pair of pipe members 74 are welded normal to flat end plates which are secured to the upper rearward surfaces of the side members 70. A pair of smaller pipe members 76 are welded to the rearward upper extremities of the members 74 and to the base plates to provide structural rigidity to the members 74.

Bales 12 to be loaded aboard ship are typically received at the steamship terminal from trucks or rail cars. Fork lift trucks or the like are utilized to pick up the bales 12 and transport them onto the receiving racks 66, which are preferably located at ship's side under the ship's cargo hook (not shown). When the bales 12 are arranged in adjacent stacks in the manner illustrated in FIGS. 8 and 4, the bales 12 are ready for hoisting. The slings 30 and 32 of the sling system 46 are disposed about the stacks of bales and thereafter the bales are hoisted aboard ship, as previously described in connection with the embodiment of FIG. 4. Of course, the bales 12 can also be stacked in different arrangements on the racks 66 for handling by the other systems of the present invention, as will be apparent.

Figure 9:
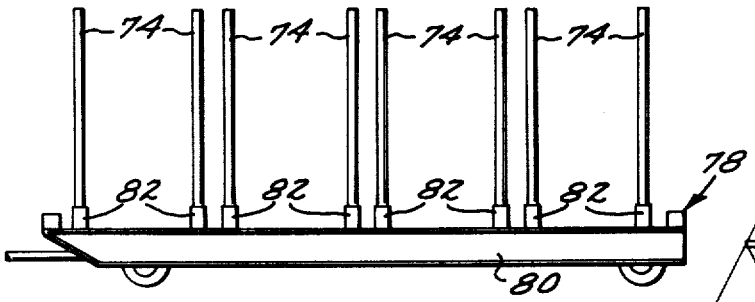
FIG. 9 is a side elevational view of a flat bed or trailer adapted for use in transporting stacks of bales on racks to and from shipside.

FIG. 9 illustrates alternative handling equipment in the form of a portable flatbed or trailer 78 which may be loaded with bales 12 by usual fork lift trucks (not shown) in a manner similar to the loading of the bales 12 onto the receiving racks 66.

The wheeled trailer frame 80 is provided along its far side with upright pipes 74 like those illustrated in FIGS. 7 and 8, and these are attached in any suitable manner to the upper surface of the trailer frame 80. In addition, elongated side members 82 extend across the width of the trailer frame 80, as viewed in FIG. 9. The upper surfaces of the side members 82 slope rearwardly and downwardly. The pipes 74 are disposed normal to these sloping surfaces so that the stacked bales 12 are tipped toward the pipes 74 for stability, similar to the tipped stowage of the bales illustrated in FIG. 8.

Use of the trailer 78 makes it possible to load the bales 12 onto the trailer frame 80 at the point where the bales are unloaded from the trucks or rail cars, the trailer 78 then being utilized to tow the stacked bales to shipside for loading onto the ship.

Figure 10:
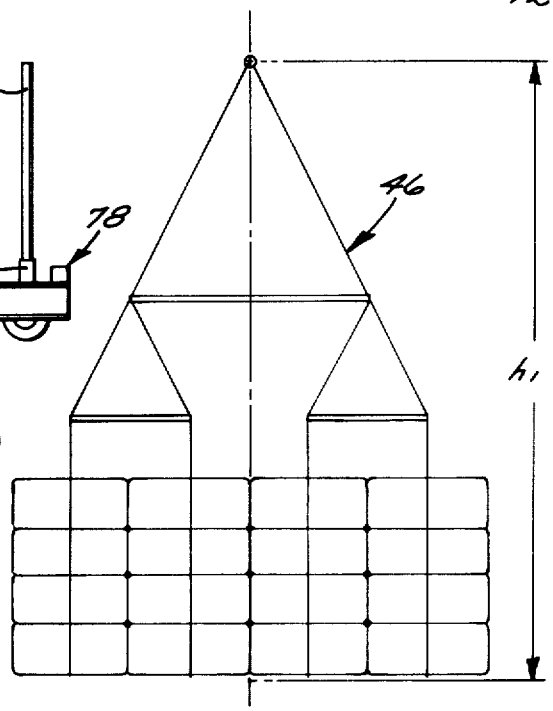
FIG. 10 is a generally diagrammatic view of the sling of FIG. 4, illustrating the overall height of such an arrangement.
Figure 11:
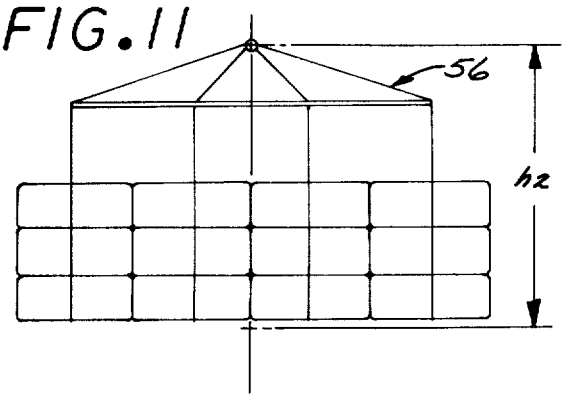
FIG. 11 is a generally diagrammatic view of the sling of FIG. 6, illustrating the overall height of such a system compared to that of FIG. 10.

FIGS. 10 and 11 illustrate the relative heights $h_1$ and $h_2$ of the sling systems 46 of FIG. 4 and 56 of FIG. 6, respectively. Use of the system 56 is preferred where it is desirable to locate the draft in the ship's hold as far as possible inwardly of the edges of the hatch (not shown), and where the 'tween decks height is limited.

Figure 12:
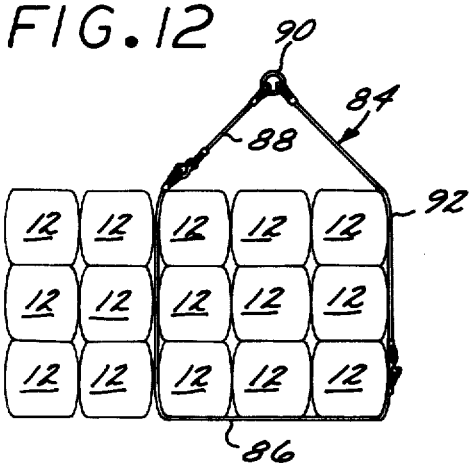
FIG. 12 is a view of a modified form of sling, compared to that of FIG. 1, which facilitates subsequent discharge of the stacked bales from the ship.

Referring now to FIGS. 12 and 13, a special stow-in sling 84 is illustrated which can be used instead of the sling 30 or 32. The sling 84 greatly facilitates subsequent discharge of the stacked bales from the ship. More particularly, the sling 84 comprises a stow-in sling portion 86 adapted to pass under the stacked bales 12 and around their rearward sides, the usual end eyes of the sling portion thereby being located at the rearward upper portion of the stack and at the forward, lower portion of the stack. The portion 86 is detachably connected by a hook carried at one end of a short lead 88 which has an upper end eye attached to a hoisting ring 90. The ring 90 is adapted to be hooked over the usual ship's cargo hook (not shown).

One end eye of a longer lead 92 is also attached to the ring 90. The opposite end eye carries a hook which is detachably secured to the lower, forwardly located end eye of the longer lead 86.

The stow-in slings 84 are preferably used when it is possible to set a draft of several stacked bales 12 into stow within the ship's hold, using only the ship's cargo fall. The stow-in portions 86 are left in place when the load is initially stowed. To discharge the load, the leads 88 and 92 are reconnected to the stow-in sling portion 86 for hoisting of the load out of the ship's hold. This procedure avoids any necessity for training a sling around the stowed bales at the port of discharge in order to hoist the bales out of the hold.

FIG. 13 illustrates another stow-in sling 94 which includes a longer stow-in portion 86*a* which extends along the front, bottom, and back of the stacked bales 12. A pair of equal length leads 88*a* are attached to the sling portion 86*a* and to a hoisting ring 90. The stow-in sling 94 is used with the stacked bales 12 of a load to be fitted into the space remaining between adjacent loads of already stowed bales 12. Use of a stow-in sling 86 would be impractical because its lower end eye would be inaccessible. However, the end eyes of the longer sling portion 86*a* terminate above the top of the load where attachment of the leads 88*a* is easily made.

Another form of sling system 96 is illustrated in FIGS. 14 and 15. The system 96 includes a rectangular box spreader 98 connected by equal length leads 100 to a hoisting ring 102 adapted for hooking onto the usual ship's cargo hook (not shown). Two pairs of slings 30 and 32 like those illustrated in conjunction with the embodiment of FIG. 1 are disposed about respective ones of a pair of sets of stacks 104 and 106, each stack being three bales deep. Thus, use of the box spreader 96 makes possible the hoisting of a draft which is six bales deep.

An X-spreader 108 is illustrated in FIG. 16, the spreader 108 being substantially identical in operation to the box spreader 98 of FIG. 15. Like numerals are utilized to designate like components.

The principal difference between the spreaders 108 and 98 is that the slings 30 and 32 are attached to the extremities of the X-shape spreader 108, rather than to the corners of the rectangular box spreader 98.

In practicing the method of the present invention, a plurality of bales are stacked with their corresponding ends in general vertical alignment, in two or more adjacent stacks, and with the bales arranged in end-to-end abutment. Thereafter, a sling is disposed about each stack and the slings are attached to a spreader which in turn is attached to a cargo fall for hoisting the draft. Through the use of this method the stacked bales are enabled to tip against one another, either at their top portions or at their lower portions, depending upon the direction of tilt. The degree of tilting is limited by forcible engagement of the end faces of the abutting bales which are being forced together, and this prevents the bales from tilting further. Thus, the draft is stabilized and the bales are prevented from tilting and tumbling out of the loops of the slings.

A variety of spreader and sling systems have been disclosed for handling various arrangements and numbers of cargo items, according to the particular application at hand.

Various modifications and changes may be made with regard to the foregoing detailed description without departing from the spirit of the invention.

I claim:

1. In combination with a load, an improved self-stabilizing multiple sling system, said load including a first plurality of substantially identical, double-ended cargo items arranged on top of one another with their corresponding ends in general vertical alignment to form a first stack, and a second plurality of said cargo items arranged on top of one another with their corresponding ends in general vertical alignment to form a second stack, each of said cargo items of said first and second stacks being unconnected each with respect to the other and oriented in end-to-end abutment, said sling system comprising:

spreader means including an elongated spreader portion configured to extend across the abutting ends of the cargo items;

hoisting bridle means attached to said spreader means and adapted for attachment to a cargo fall;

a pair of flexible slings for arrangement in loops about said first and second stacks, respectively, whereby each of said loops overlies the bottom and sides of, and forms an apex above, the associated one of said stacks;

and means coupling the opposite ends of said slings to said spreader portion, said slings being spaced apart a predetermined distance thereby to locate each said sling between the ends of its associated stack whereby lifting forces tend to urge together the ends of at least some of said cargo items in said first stack against the abutting ends of said cargo items of said second stack to stabilize the draft.

2. A self-stabilizing multiple sling system according to claim 1 wherein said bridle means comprises a pair of leads of equal length attached to opposite ends of said spreader means.

3. A self-stabilizing multiple sling system according to claim 1 wherein each said sling comprises a stow-in sling segment having a pair of end eyes and adapted to pass under and on opposite sides of the associated stack for location of said eyes at the top of said associated stack, each said sling further comprising a bridle portion attached to said spreader means and including a pair of leads of substantially equal length detachably connected to said eyes, respectively.

4. A self-stabilizing multiple sling system for hoisting a load which includes a first plurality of substantially identical, double-ended cargo items arranged on top of one another with their corresponding ends in general vertical alignment to form a first stack, a second plurality of said cargo items arranged on top of one another with their corresponding ends in general vertical alignment to form a second stack, said cargo items of said first and second stacks being oriented in end-to-end abutment, a third plurality of said cargo items arranged on top of one another with their corresponding ends in general vertical alignment to form a third stack, and a fourth plurality of said cargo items arranged on top of one another with their corresponding ends in general vertical alignment to form a fourth stack, said cargo items of said second and third stacks being oriented in end-to-end abutting relation, and said cargo items of said third and fourth stacks being oriented in end-to-end abutting relation, said sling system comprising:

spreader means including a first spreader, a second spreader and a third spreader;

hoisting bridle means adapted for attachment to a cargo fall and including a first bridle attached to opposite ends of said first spreader and to one end of said third spreader, further including a second bridle attached to opposite ends of said second spreader and to the other end of said third spreader;

a first pair of slings attached to said first spreader for looping about said first and second stacks, respectively, said slings being spaced apart on said first spreader a predetermined distance thereby to locate each said sling between the ends of its associated stack whereby lifting forces tend to urge together the ends of at least some of said cargo items in said first stack against the abutting ends of said cargo items of said second stack to stabilize the draft; and a second pair of slings attached to said second spreader for looping about said second and third stacks, respectively, said slings being spaced apart on said second spreader a predetermined distance thereby to locate each said sling between the ends of its associated stack whereby lifting forces tend to urge together the ends of at least some of said cargo items in said fourth stack against the abutting ends of said cargo items of said third stack and to urge together the ends of at least some of said cargo items in said third stack against the abutting ends of said cargo items of said second stack to stabilize the draft.

5. In combination with a load, an improved self-stabilizing multiple sling system, said load including a first plurality of substantially identical, double-ended cargo items arranged on top of one another with their corresponding ends in general vertical alignment to form a first stack, a second plurality of said cargo items arranged on top of one another with their corresponding ends in general vertical alignment to form a second stack, each of said cargo items of said first and second stacks being unconnected each with respect to the other and oriented in end-to-end abutment, a third plurality of said cargo items arranged on top of one another with their corresponding ends in general vertical alignment to form a third stack, and a fourth plurality of said cargo items arranged on top of one another with their corresponding ends in general vertical alignment to form a fourth stack, each of said cargo items of said second and third stacks being unconnected each with respect to the other and oriented in end-to-end abutting relation, and each of said cargo items of said third and fourth stacks being unconnected each with respect to the other and oriented in end-to-end abutting relation, said sling system comprising:

spreader means including an elongated first spreader portion configured to extend across the abutting ends of the cargo items in said first and second stacks, and including an elongated second spreader portion configured to extend across the abutting ends of the cargo items in said third and fourth stacks;

hoisting bridle means attached to said spreader means and adapted for attachment to a cargo fall; and four flexible slings for arrangement in loops about said first, second, third and fourth stacks, respectively, whereby each of said loops overlies the bottom and sides of, and forms an apex above, the associated one of said stacks;

and means coupling the opposite ends of two of said slings to said first spreader portion, and the opposite ends of the other two of said slings to said second spreader portion, said slings being spaced apart predetermined distances thereby to locate each said sling between the ends of its associated stack whereby lifting forces tend to urge together the ends of at least some of said cargo items in said fourth stack against the abutting ends of said cargo items of said third stack and to urge together the ends of at least some of said cargo items in said third stack against the abutting ends of said cargo items of said second stack to stabilize the draft.

6. A self-stabilizing multiple sling system for hoisting a load which includes a first plurality of substantially identical, double-ended cargo items arranged on top of one another with their corresponding ends in general vertical alignment to form a first stack, a second plurality of said cargo items arranged on top of one another with their corresponding ends in general vertical alignment to form a second stack, said cargo items of said first and second stacks being oriented in end-to-end abutment, a third plurality of said cargo items arranged on top of one another with their corresponding ends in general vertical alignment to form a third stack, and a fourth plurality of said cargo items arranged on top of one another with their corresponding ends in general vertical alignment to form a fourth stack, said cargo items of said third and fourth stacks being oriented in end-to-end abutting relation, said third and fourth stacks being located behind said first and second stacks, respectively, with the sides of the forwardly located cargo items of said third and fourth stacks engaged upon the sides of the rearwardly located cargo items of said first and second stacks, respectively, said sling system comprising:

spreader means including a rectangular box spreader having four corners;

hoisting bridle means adapted for attachment to a cargo fall and including first, second, third and fourth leads attached to said four corners of said spreader means, respectively; and first, second, third and fourth slings attached to said four corners of said box spreader, respectively, for looping about said first, second, third and fourth stacks, respectively, said slings being oriented on said box spreader thereby to locate each said sling between the ends of its associated stack whereby lifting forces tend to urge together the ends of at least some of said cargo items in said first and third stacks against the abutting ends of said cargo items of said second and fourth stacks, respectively, to stabilize the draft.

7. A self-stabilizing multiple sling system for hoisting a load which includes a first plurality of substantially identical, double-ended cargo items arranged on top of one another with their corresponding ends in general vertical alignment to form a first stack, a second plurality of said cargo items arranged on top of one another with their corresponding ends in general vertical alignment to form a second stack, said cargo items of said first and second stacks being oriented in end-to-end abutment, a third plurality of said cargo items arranged on top of one another with their corresponding ends in general vertical alignment to form a third stack, and a fourth plurality of said cargo items arranged on top of one another with their corresponding ends in general vertical alignment to form a fourth stack, said cargo items of said third and fourth stacks being oriented in end-to-end abutting relation, said third and fourth stacks being located behind said first and second stacks, respectively, with the sides of the forwardly located cargo items of said third and fourth stacks engaged upon the sides of the rearwardly located cargo items of said first and second stacks, respectively, said sling system comprising:

spreader means including an X-shape spreader having four legs;

hoisting bridle means adapted for attachment to a cargo fall and including first, second, third and fourth leads attached to the extremities of said four legs of said spreader means, respectively; and first, second, third and fourth slings attached to said extremities of said four legs of said spreader, respectively, for looping about said first, second, third and fourth stacks, respectively, said slings being oriented on said spreader thereby to locate each said sling between the ends of its associated stack whereby lifting forces tend to urge together the ends of at least some of said cargo items in said first and third stacks against the abutting ends of said cargo items of said second and fourth stacks, respectively, to stabilize the draft.

8. In combination with a load which includes a first plurality of substantially identical, double-ended cargo items arranged on top of one another with their corresponding ends in general vertical alignment to form a first stack, and a second plurality of said cargo items arranged on top of one another with their corresponding ends in general vertical alignment to form a second stack, each of said cargo items of said first and second stacks being unconnected each with respect to the other and oriented in end-to-end abutment, an improved multiple sling system for hoisting said load, said sling system comprising:

spreader means including an elongated spreader portion extending across the abutting ends of the cargo items;

hoisting bridle means attached to said spreader means and adapted for attachment to a cargo fall;

a pair of flexible slings attached to said spreader means and arranged in loops about said first and second stacks, respectively, whereby each of said loops overlies the bottom and sides of, and forms an apex above, the associated one of said stacks;

and means coupling the opposite ends of said slings to said spreader portion, said slings being spaced apart on said spreader portion a predetermined distance thereby to locate each said sling between the ends of its associated stack whereby lifting forces tend to urge together the ends of at least some of said cargo items in said first stack against the abutting ends of said cargo items of said second stack to stabilize the draft.

9. A method of hoisting a plurality of substantially identical, double-ended cargo items unconnected each with respect to the other, comprising the steps of:

arranging a first plurality of said cargo items on top of one another with their corresponding ends in general vertical alignment to form a first stack;

arranging a second plurality of said cargo items on top of one another with their corresponding ends in general vertical alignment to form a second stack;

arranging said cargo items of said first and second stacks in end-to-end abutment;

arranging a pair of flexible slings in spaced apart loops about said first and second stacks, respectively, between the ends of the cargo items whereby each of said loops overlies the bottom and sides of, and forms an apex above, the associated one of said stacks;

coupling the opposite ends of said slings to an elongated spreader element extending across the abutting ends of the cargo items and forming part of a spreader means; and hoisting said spreader means whereby lifting forces tend to urge together the ends of at least some of said cargo items in said first stack against the abutting ends of said cargo items of said second stack to stabilize the draft.

10. A self-stabilizing multiple sling system for hoisting a load which includes a first plurality of substantially identical, double-ended cargo items arranged on top of one another with their corresponding ends in general vertical alignment to form a first stack, and a second plurality of said cargo items arranged on top of one another with their corresponding ends in general vertical alignment to form a second stack, said cargo items of said first and second stacks being oriented in end-to-end abutment, said sling system comprising:

elongated spreader means;

hoisting bridle means attached to said spreader means and adapted for attachment to a cargo fall; and a pair of slings attached to said spreader means for looping about said first and second stacks, respectively, said slings being spaced apart on said spreader means a predetermined distance thereby to locate each said sling between the ends of its associated stack whereby lifting forces tend to urge together the ends of at least some of said cargo items in said first stack against the abutting ends of said cargo items of said second stack to stabilize the draft, each said sling comprising a stow-in sling segment having a pair of end eyes and adapted to pass behind and under the associated stack for location of one of said end eyes adjacent the upper rear of said associated stack and for location of the other of said end eyes adjacent the lower front of said associated stack, each said sling further comprising a bridle portion attached to said spreader means and including a short lead detachably connected to said one of said end eyes, and a longer lead detachably connected to said other of said end eyes.

* * * * *